US010094365B2

(12) United States Patent
Bidell et al.

(10) Patent No.: US 10,094,365 B2
(45) Date of Patent: Oct. 9, 2018

(54) HYDROSTATIC AXIAL PISTON MACHINE

(71) Applicant: Robert Bosch GmbH, Stuttgart (DE)

(72) Inventors: Alexander Bidell, Ulm (DE); Wolfgang Mayer, Duermetingen (DE); Raimund Roth, Nersingen (DE)

(73) Assignee: Robert Bosch GmbH, Stuttgart (DE)

( * ) Notice: Subject to any disclaimer, the term of this patent is extended or adjusted under 35 U.S.C. 154(b) by 558 days.

(21) Appl. No.: 14/568,566

(22) Filed: Dec. 12, 2014

(65) Prior Publication Data

US 2015/0167630 A1 Jun. 18, 2015

(30) Foreign Application Priority Data

Dec. 12, 2013 (DE) ..... 10 2013 225 695
Apr. 15, 2014 (DE) ..... 10 2014 207 158

(51) Int. Cl.
*F04B 1/32* (2006.01)
*F04B 1/20* (2006.01)
*F04B 39/00* (2006.01)

(52) U.S. Cl.
CPC ..... *F04B 1/328* (2013.01); *F04B 1/2021* (2013.01); *F04B 39/0055* (2013.01)

(58) Field of Classification Search
CPC ..... F04B 1/328; F04B 1/2021; F04B 1/324; F04B 1/22; F04B 1/2078; F04B 1/2035; F04B 1/2042; F04B 1/205; F04B 1/24; F04B 1/306; F16H 61/46; F16H 47/04; F01B 3/0047; F01B 3/0058
See application file for complete search history.

(56) References Cited

U.S. PATENT DOCUMENTS 5,839,889 A * 11/1998 Folsom ..... F04C 14/20 418/31
6,077,050 A * 6/2000 Beck ..... F01B 3/0073 417/201
7,799,221 B1 * 9/2010 MacHarg ..... B01D 61/025 210/321.66
2005/0025648 A1 * 2/2005 Shimizu ..... F04B 27/0878 417/521
2013/0055888 A1 * 3/2013 Ohno ..... F01B 3/0047 91/499
2015/0128796 A1 * 5/2015 Krittian ..... F04B 1/2021 91/505

FOREIGN PATENT DOCUMENTS

EP 1 068 450 B1 9/2003

* cited by examiner

*Primary Examiner* — Devon Kramer
*Assistant Examiner* — Christopher Brunjes
(74) *Attorney, Agent, or Firm* — Maginot, Moore & Beck LLP

(57) ABSTRACT

A hydrostatic axial piston machine of swashplate type of construction includes a rotatable cylinder drum that has a plurality of cylinder bores, which are arranged approximately axially, formed in the cylinder drum. A piston is inserted into each cylinder bore at one side. At the other side, each cylinder bore is freely connected via a respective passage opening to a face surface of the cylinder drum. The face surface bears against a static distributor disk. The respective mouths arranged at the face surface, or the passage openings as a whole, have a cross section that has two or four widenings with rounded corners so as to enlarge the cross-sectional area in relation to the circular shape.

11 Claims, 5 Drawing Sheets

HYDROSTATIC AXIAL PISTON MACHINE

This application claims priority under 35 U.S.C. § 119 to patent application nos. DE 10 2013 225 695.7, filed on Dec. 12, 2013 in Germany, and DE 10 2014 207 158.5, filed on Apr. 15, 2014 in Germany, the disclosures of which are incorporated herein by reference in their entirety.

BACKGROUND

The disclosure relates to a hydrostatic axial piston machine.

In hydrostatic axial piston machines of swashplate type of construction, a cylinder drum in which multiple cylinder bores are provided is oriented obliquely with respect to a drive shaft, wherein, in the cylinder drum, there are provided cylinder bores which are distributed uniformly about the circumference and in each of which there is guided a piston which is pivotably coupled by means of a ball joint to the drive shaft. When the drive shaft rotates synchronously with the cylinder drum, the pistons revolve around a longitudinal axis and perform a reciprocating movement which is dependent on the oblique orientation between the cylinder drum and the drive shaft.

The cylinder drum is, at its face side facing away from the drive shaft, pressed against a static control disk or distributor disk which serves as a sealing rotary bearing and which has a high-pressure opening and a low-pressure opening. Each cylinder bore has a passage opening in the cylinder drum, said passage opening passing once over the high-pressure opening and once over the low-pressure opening during one rotation of the cylinder drum. For this purpose, the two openings of the distributor disk are kidney-shaped and extend over a circular arc along the circular path of the passage openings.

It is known from the prior art that the passage openings are oriented obliquely with respect to the cylinder bores, such that the mouths of the passage openings in the face surface of the cylinder drum lie on a smaller pitch circle than the cylinder bores. Normally, the passage openings are of circular cylindrical form and have a smaller diameter than the cylinder bores. During the operation of the axial piston machine, it is necessary, via the passage openings, for the associated cylinder bore to be charged and evacuated rapidly with the lowest possible resistance.

Document EP 1 068 450 B1 discloses a hydrostatic axial piston machine of swashplate type of construction, in which the mouths of the passage openings have two straight edge sections. Here, the communicating high-pressure and low-pressure openings of the distributor disk have edge sections adapted to the mouths and with the same orientation.

By contrast, the disclosure is based on the object of providing a hydrostatic axial piston machine, the throughflow openings of which are maximized and, at the same time, permits an optimized throughflow during the charging and evacuation of the cylinder bores.

SUMMARY

The object is achieved by a hydrostatic axial piston machine having the features of disclosure.

The hydrostatic axial piston machine has a rotatable cylinder drum in which a multiplicity of approximately axially arranged cylinder bores is formed. A piston is inserted into each cylinder bore at one side, and each cylinder bore is freely connected at the other side via a respective passage opening to a face surface, which bears against a static distributor disk, of the cylinder drum. The cylinder drum is preferably inclined, or capable of being inclined, relative to a drive shaft in accordance with the swashplate principle. According to the disclosure, the respective mouths, arranged at the face surface, of the passage openings have a cross section which has two or four widenings with rounded corners. This means that, at two or four points of the cross section, regions are provided which are widened in relation to a circular cross section and whose boundary sections have minimal radii of curvature, wherein, in between, there may extend boundary sections with a greater radius of curvature (curved in the same direction or in opposite directions) or straight boundary sections. The throughflow openings are thus maximized, and an optimized throughflow during the charging and evacuation of the cylinder bores is permitted.

What is optimum in terms of flow is a continuous profile of the entire boundary of the cross section.

For manufacturing-related reasons, it is preferable for the cross section to be mirror-symmetrical with respect to a line of symmetry which is arranged radially with respect to the cylinder drum.

The flow through the passage opening is optimized if the passage opening has, adjacent to the mouth or particularly preferably over its entire length, the same cross section as the mouth. In this way, the axial piston machine according to the disclosure can be used as a pump of an excavator which operates at high altitudes with low ambient pressure. The nominal rotational speed of the pump can be increased. Cavitation damage is reduced or prevented entirely.

If the cross section has two lateral boundary sections which are straight, the cross section can be maximized in terms of its size.

If the lateral boundary sections run in the radial direction of the cylinder drum, the closed surfaces or webs that are formed between the mouths on the face surface of the cylinder drum are minimized, and thus the cross-sectional area is maximized.

For manufacturing-related reasons, it is preferable for the two lateral boundary sections to be mirror-symmetrical with respect to the radial line of symmetry.

The boundary of the cross section may have—as viewed radially—an outer curvature and an inner curvature. The two curvatures may be circular arcs.

For manufacturing-related reasons, it is preferable for the two curvatures to be mirror-symmetrical with respect to the line of symmetry.

It is preferable for the outer curvature to be less intensely curved than the inner curvature. If the curvatures are circular arcs, then it is correspondingly the case that the outer circular arc has a larger radius than the inner circular arc.

If the two curvatures have opposite directions of curvature, the flow is further optimized.

In a first exemplary embodiment, two rounded corners of the boundary are provided radially at the outside. These are preferably mirror-symmetrical with respect to the line of symmetry.

Each of the two corners merges in preferably continuous fashion into one of the two straight boundary sections.

In a preferred exemplary embodiment of the axial piston machines according to the disclosure, the respective inner curvature of the cross sections of the mouths is of circular arc-shaped form. It is then particularly preferable for the respective outer curvature of the mouths to be arranged radially further toward the outside than an "imaginary" circular arc-shaped elongation of the inner curvature. Thus, the radius of the rounded corners can be increased in relation to an exemplary embodiment in which the outer curvature tangentially intersects the circular arc-shaped elongation of the inner curvature. Thus, the mechanical load owing to the notch effect at the (preferably two) rounded corners of the mouths of the passage openings of the cylinder drum is reduced.

This results in a smallest distance between the outer curvature and the circular arc-shaped elongation of the inner curvature. Said distance is measured along the line of symmetry of the cross section of the mouth. It is then possible for the radius of the rounded corners to be increased, by twice the distance, in relation to the exemplary embodiment in which the outer curvature tangentially intersects the circular arc-shaped elongation of the inner curvature.

The distributor disk, against which the face surface of the cylinder drum bears, of the axial piston machine according to the disclosure is also referred to as control disk, and may be lens-shaped. In the distributor disk there are formed a kidney-shaped suction port and a kidney-shaped pressure port, to which the mouths of the passage openings are alternately connected. The radial position and radial width of the kidney-shaped pressure port are responsible for the release of pressure between the distributor disk and the cylinder drum. So as not to disadvantageously modify an axial piston machine which is to be equipped with the cross sections with the above-described distance and which has already been optimized with regard to the radial position and radial width of the kidney-shaped pressure port, the kidney-shape pressure port is not modified.

From a flow aspect, it is important for the radial extent of the kidney-shaped suction port of the distributor disk to be adapted to the radial width of the cross sections of the mouths. For this purpose, the kidney-shaped suction port may be broadened radially, by the distance mentioned above, in relation to the kidney-shaped pressure port.

From a flow aspect, it is furthermore important for the kidney-shaped suction port to be adapted in terms of its radial position to the radial position of the mouths. For this purpose, the kidney-shaped suction port may be arranged on the distributor disk radially further to the outside than the kidney-shaped pressure port by half of the distance mentioned above. A pitch circle diameter of the kidney-shaped suction port is thus increased, by half of the distance, in relation to a pitch circle diameter of the kidney-shaped pressure port.

In a particularly preferred exemplary embodiment with maximized radii and with minimized notch effect at the rounded corners, seven passage openings are provided on the cylinder drum.

In a preferred exemplary embodiment, the distance mentioned above is 1 mm.

In a further exemplary embodiment, four rounded corners are provided. The corners are preferably arranged in pairs, mirror-symmetrically with respect to the line of symmetry. It is preferable here for one of the two straight boundary sections to extend in each case between two corners.

The two curvatures or circular arcs may also have the same directions of curvature.

BRIEF DESCRIPTION OF THE DRAWINGS

Various exemplary embodiments of a hydrostatic axial piston machine according to the disclosure will be described in detail below on the basis of the figures, in which.

DETAILED DESCRIPTION

Figure 1:
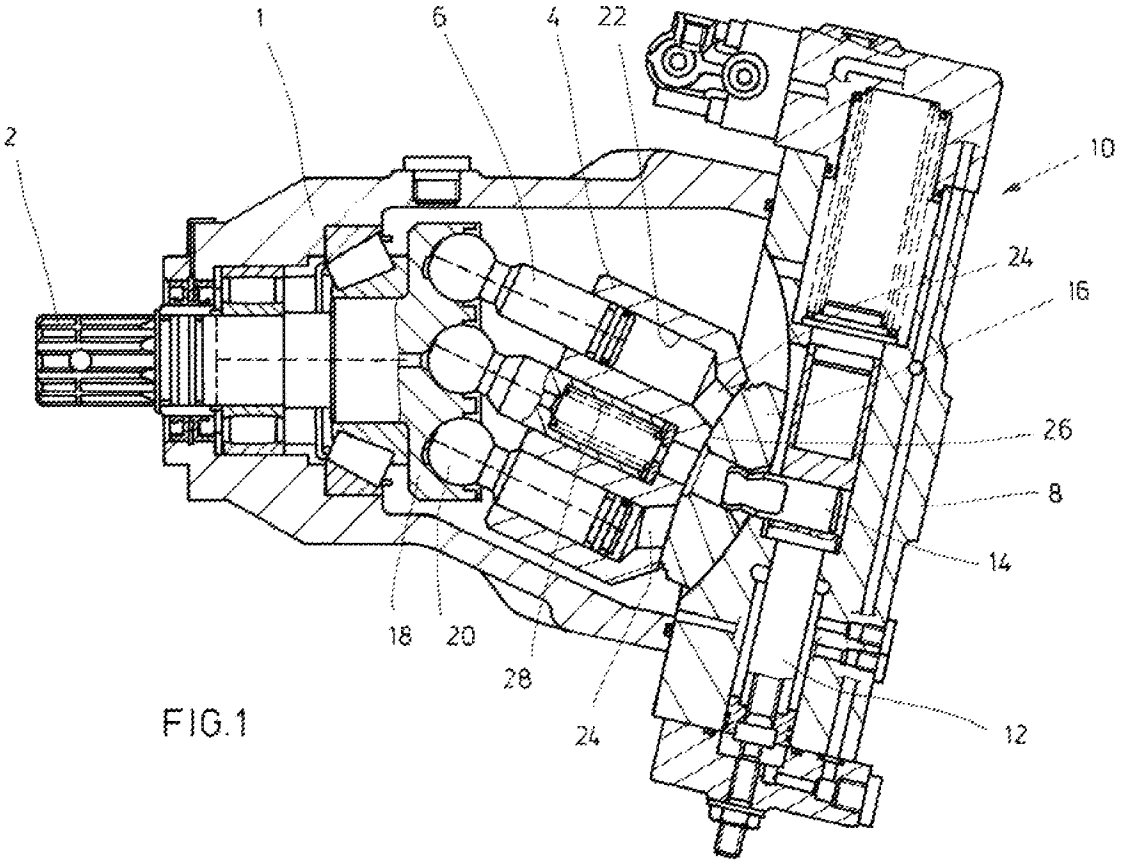
FIG. 1 shows a first exemplary embodiment in a longitudinal section.

FIG. 1 shows a first exemplary embodiment of the hydrostatic axial piston machine according to the disclosure of swashplate type of construction in a longitudinal section. It has a first housing part 1, in which a drive shaft 2 is mounted and in which a cylinder drum 4 with pistons 6 are arranged. Since a swept volume of the pistons 6 is designed to be adjustable, a second housing part 8 is provided in which an adjustment device 10 is arranged. Said adjustment device has an actuating piston 12 which, via a radial journal 14, can move a lens-shaped control disk or distributor disk 16 such that, in the process, an oblique position of the cylinder drum 4 with respect to the drive shaft 2 can be varied. The drive shaft 2 has a radial widening or a flange 18 to which, via ball joints 20, a respective piston 6 is articulatedly connected. More precisely, the ball joints 20 are distributed uniformly about the circumference of the flange 18 in the same way as cylinder bores 22 are provided, so as to be distributed uniformly about the circumference, in the cylinder drum 4.

Each cylinder bore 22 is connected, at the side facing away from the piston 6 and thus away from the flange 18, via a passage opening 24 to a respective mouth which is arranged in a concavely curved face surface 26, which serves as a contact surface, of the cylinder drum 4. The cylinder drum 4 is pressed by way of its face surface 26 against a correspondingly convexly curved contact surface of the distributor disk 16 by means of a spring 28 and by a force of the high-pressure-conducting cylinder bores 22.

During the operation of the axial piston machine according to the disclosure, the drive shaft 2 and the cylinder drum 22 rotate, and in so doing, cause the pistons 6 to move on a circulatory path. Owing to the oblique orientation, the pistons 6 perform the reciprocating movement in the cylinder bores 22. During one rotation of the cylinder drum 4, each passage opening 24 passes over a low-pressure opening and a high-pressure opening of the distributor disk 16. The two openings are not shown in the longitudinal section through the distributor disk 16 shown in FIG. 1, and are each in the form of a circular arc.

Figure 2:
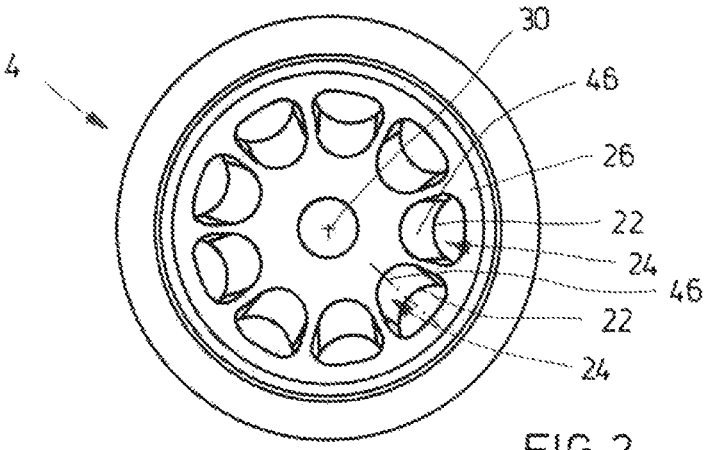
FIG. 2 shows a cylinder drum of the hydrostatic axial piston machine as per FIG. 1 in a first view.

FIG. 2 shows the cylinder drum 4 of the first exemplary embodiment as per FIG. 1 in a view of the face side 26. In this case, a drum axis 30 of the cylinder drum 4 runs perpendicular to the plane of the drawing. Parallel thereto (in the background), the cylinder bores 22 can be seen. Oriented obliquely with respect thereto are the passage openings 24 which each have two radially outer widenings such that, overall, the cross sections of the passage openings 24 are widened in relation to the circular cylindrical passage openings of the prior art.

Figure 3:
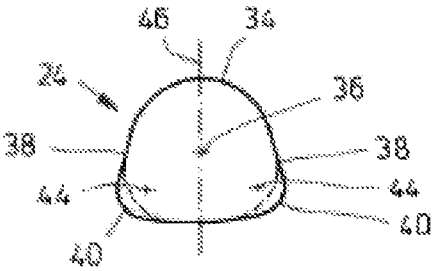
FIG. 3 shows a passage opening of the cylinder drum as per FIG. 2 in a cross section.

FIG. 3 shows one of the cross sections of the passage openings 24 as per the first exemplary embodiment. In this case, a boundary of the cross section has a radially outer curvature 32 and a radially inner curvature 34. The inner curvature 34 is in the shape of a circular arc about a middle central axis 36, and at the sides, merges tangentially into a respective straight boundary section 38. The outer curvature 32 has a tangential point of contact 33 with the imaginary circular arc-shaped elongation 35 of the radially inner curvature 34. The radially outer curvature 32 merges laterally into two rounded corners 40 which extend in circular arc-shaped form about the respective outer central axis 44. The two rounded corners 40 merge in each case tangentially into the associated straight boundary section 38. Thus, the two outer central points 42 together with the middle central axis 36 form an isosceles triangle. Each straight boundary section 38 runs parallel to the straight boundary section of the adjacent passage opening 24 (cf. FIG. 2).

Figure 4:
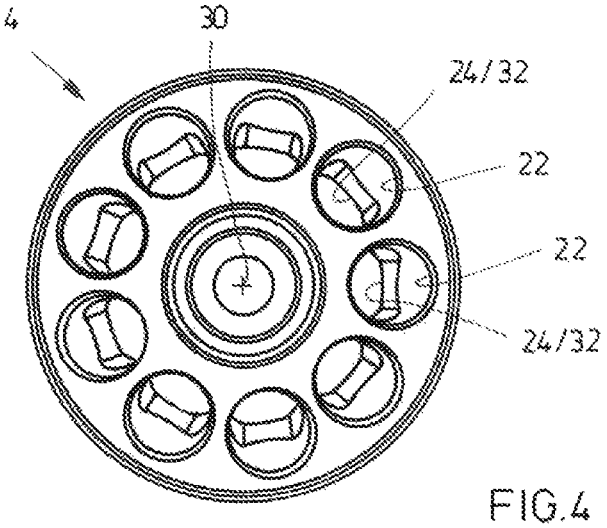
FIG. 4 shows the cylinder drum as per FIG. 2 in a second view.

FIG. 4 shows the cylinder drum 4 as per FIG. 2 in a view of a face surface which is situated opposite the face surface 26 shown in FIG. 2. In this case, the cylinder bores 22 can be seen in the foreground, whereas the outer curvatures 32 of the respective passage opening 24 can be seen in the background.

Figure 5:
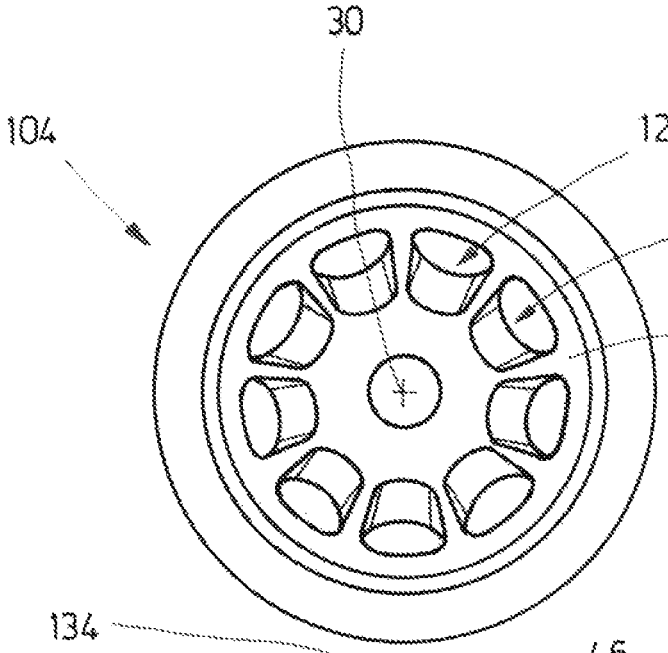
FIG. 5 shows a cylinder drum of a second exemplary embodiment of a hydrostatic axial piston machine according to the disclosure in a view.

FIG. 5 shows a second exemplary embodiment of a cylinder drum 104 according to the disclosure in a view of its face surface 26 which bears against the distributor disk 16. In this case, the shaping of the passage openings 124 has been modified in relation to that of the first exemplary embodiment such that the throughflow cross sections have been further enlarged.

Figure 6:
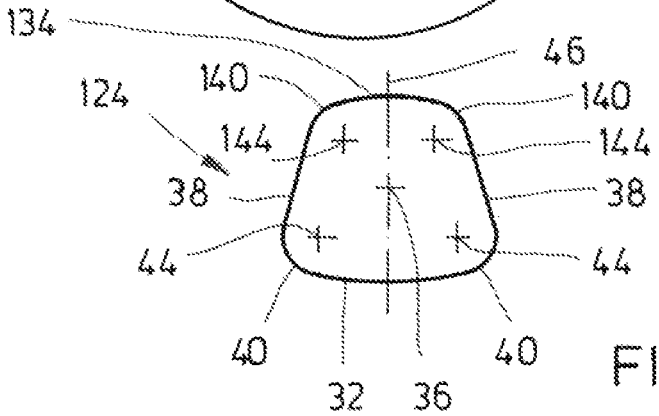
FIG. 6 shows a passage opening of the cylinder drum as per FIG. 5 in a cross section.

FIG. 6 shows a cross section of a passage opening 124 as per the second exemplary embodiment. The outer curvature 32 with the two rounded corners 40 and the outer central axes 44 thereof correspond to those of the first exemplary embodiment as per FIG. 3. By contrast to the first exemplary embodiment, the two straight boundary sections 38 each merge tangentially into further rounded corners 140, which are connected to one another via an outer curvature 32. In this case, the outer central axes 44 of the two outer rounded corners 40 and the two inner central points 144 of the two inner rounded corners 140 form a trapezoid.

Figure 7:
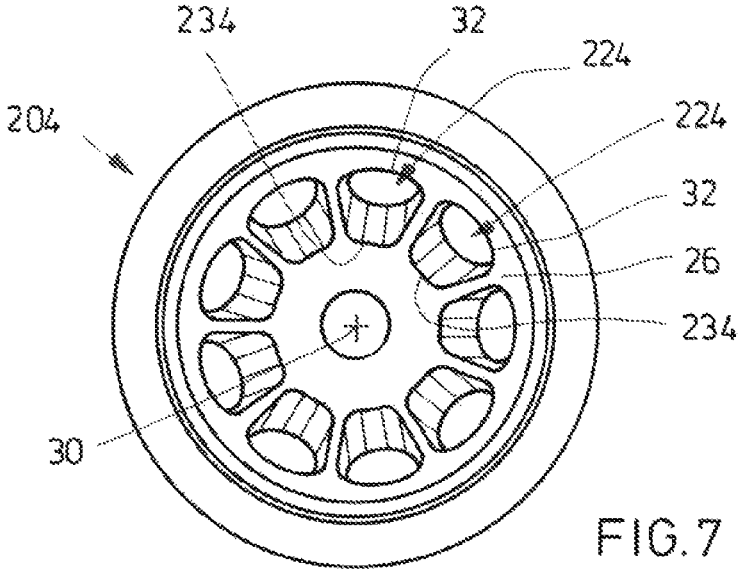
FIG. 7 shows a cylinder drum of a third exemplary embodiment of a hydrostatic axial piston machine according to the disclosure in a first view.

FIG. 7 shows a cylinder drum 204 of an axial piston machine according to the disclosure as per a third exemplary embodiment. In this case, FIG. 7 again shows the view of the face side 26 of said cylinder drum. A third variant of the passage openings 224 is shown which substantially corresponds to that of the second exemplary embodiment as per FIGS. 5 and 6. The main difference can be seen in the fact that, between the two inner rounded corners 140, there is provided in each case an inner curvature 234, the direction of curvature of which corresponds to that of the outer curvature 32. In this case, the inner curvature 234 is more intensely curved than the outer curvature 32. It is preferable for the inner curvatures 234 of all of the passage openings 224 to be arranged on an inner circle, whereas the outer curvatures 32 of all of the passage openings 224 are arranged on an outer circle. In this case, the two passage openings 224 as per the third exemplary embodiment have the four rounded corners 40, 140 that have already been explained in principle with regard to FIG. 6.

Figure 8:
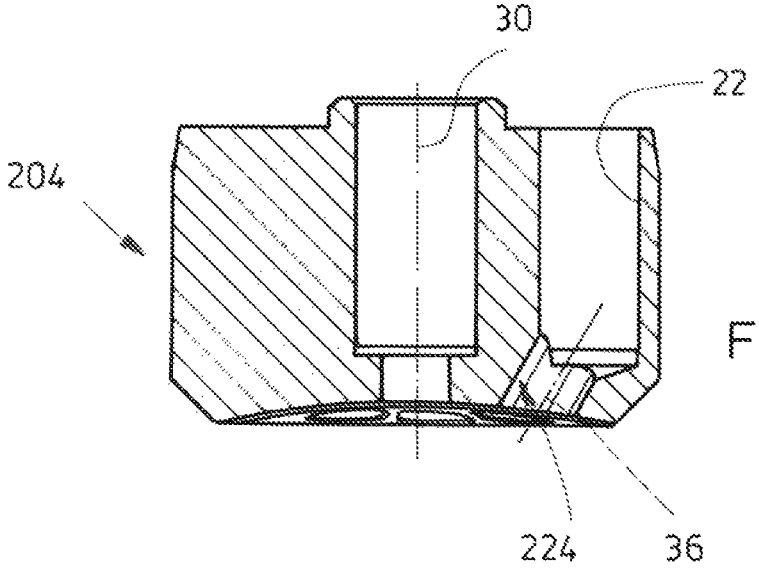
FIG. 8 shows the cylinder drum as per FIG. 7 in a longitudinal section.

FIG. 8 shows, in a longitudinal section, the cylinder drum 204 of the third exemplary embodiment as per FIG. 7. It can be seen here that the middle central axis 36 of the passage opening has—as already explained—an angle of inclination with respect to the longitudinal axis of the associated cylinder bore 22.

Figure 9:
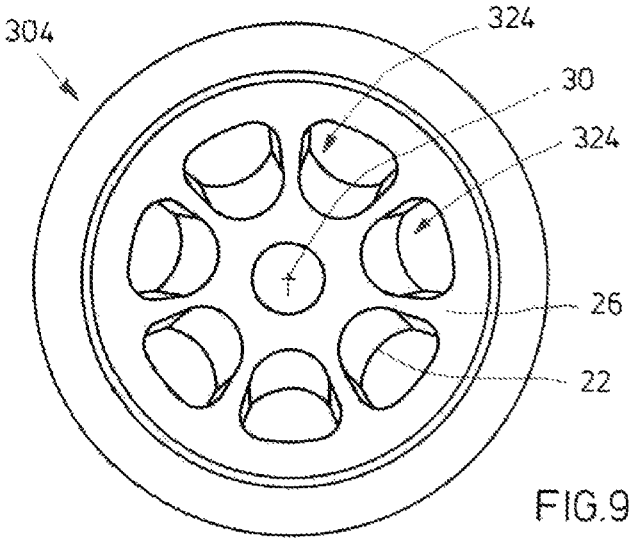
FIG. 9 shows a cylinder drum of a fourth exemplary embodiment of a hydrostatic axial piston machine according to the disclosure in a view.

FIG. 9 shows a cylinder drum 304 of a fourth exemplary embodiment of the axial piston machine according to the disclosure in a view of the face surface 26. To maximize the size of the cross sections of the passage openings 324, the cylinder drum 304 has seven passage openings 324 with corresponding mouths and with corresponding cylinder bores 22.

Figure 10:
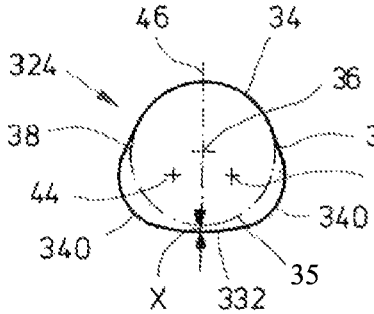
FIG. 10 shows a passage opening of the cylinder drum as per FIG. 9 in a cross section.

FIG. 10 shows one of the passage openings 324 of the cylinder drum 304 as per FIG. 9 in a cross section. In this case, a boundary of the cross section has a radially outer curvature 332 and a radially inner curvature 34. The inner curvature 34 is of circular arc-shaped form about the middle central axis 36 and, at the sides, merges tangentially into a respective straight boundary section 38. The outer curvature 332 is at a distance from the imaginary circular arc-shaped elongation 35 of the radially inner curvature 34. The outer curvature 332 is not of circular arc-shaped form and is further remote than the inner curvature 34 from the central axis 36.

The outer curvature 332 merges laterally into two rounded corners 340 which extend in circular arc-shaped form about the respective outer central axis 44. The two rounded corners 340 merge in each case tangentially into the associated straight boundary section 38. Thus, the two outer central points 42 together with the middle central axis 36 form an isosceles triangle. Each straight boundary section 38 runs parallel to the straight boundary section of the adjacent passage opening 324 (cf. FIG. 9).

Thus, the cross section of the fourth exemplary embodiment has been enlarged in relation to that of the first exemplary embodiment as per FIG. 3 by virtue of the outer curvature 332 having been shifted outward by the distance x, whereby it has been possible to increase the respective radius of the two rounded corners 340 by 2*x.

Figure 11:
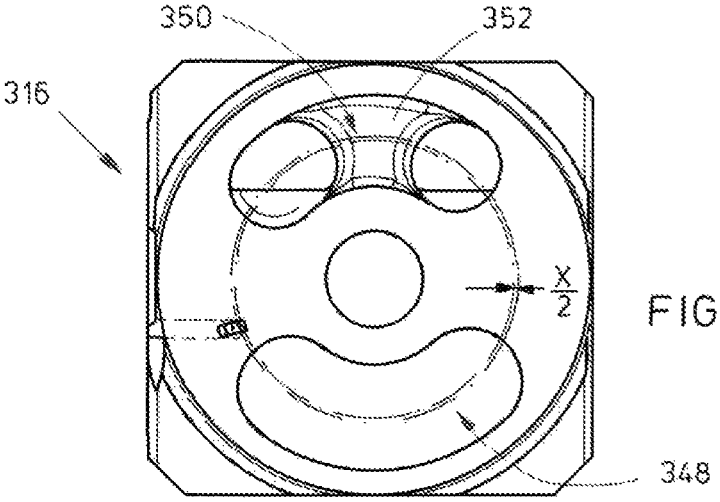
FIG. 11 shows a distributor disk of the fourth exemplary embodiment as per FIGS. 9 and 10 in a view.

FIG. 11 shows a distributor disk 316 of the fourth exemplary embodiment as per FIGS. 9 and 10 in a view. Said distributor disk has a kidney-shaped suction port 348 and a kidney-shaped pressure port 350 with a web 352. The kidney-shaped pressure port 350 runs along the inner pitch circle shown in FIG. 11. The kidney-shaped suction port 348 runs along the outer pitch circle shown in FIG. 11. The radii of the two pitch circles have a difference in magnitude which corresponds to half of the distance, x/2. Thus, the kidney-shaped suction port 348 is situated radially further to the outside than the kidney-shaped pressure port 350 by x/2. Furthermore, the kidney-shaped suction port 348 has a radial width which is increased, by the distance x, in relation to that of the kidney-shaped pressure port 350. Thus, the kidney-shaped suction port 348 is optimally matched to the mouths of the passage openings 342 (as per FIGS. 9 and 10), wherein the kidney-shaped pressure port 350 is not adapted to the outer curvatures 342 that have been shifted outward by the distance x, and is thus also adapted to the cross sections of the first exemplary embodiment (as per FIGS. 2 and 3).

The passage openings 24; 124; 224; 324 of all of the exemplary embodiments shown are mirror-symmetrical with respect to a respective line of symmetry 46 which extends radially with respect to the drum axis 30.

The disclosure discloses a hydrostatic axial piston machine of swashplate type of construction, having a rotatable cylinder drum in which cylinder bores arranged approximately axially are formed. A piston is inserted into each cylinder bore at one side, and each cylinder bore is freely connected at the other side via a respective passage opening to a face surface, which bears against a static distributor disk, of the cylinder drum. In this case, the respective mouths arranged at the face surface, or the passage openings as a whole, have a cross section which, in order to enlarge the cross-sectional area in relation to the circular shape, has two or four widenings with rounded corners.

LIST OF REFERENCE SYMBOLS

1 First housing part
2 Drive shaft
4; 104; 204; 304 Cylinder drum
6 Piston
8 Second housing part
10 Adjustment device
12 Actuating piston
14 Journal
16; 316 Distributor disk
18 Flange
20 Ball joint
22 Cylinder bore
24; 124; 224; 324 Passage opening
26 Face surface
28 Spring
30 Drum axis
32; 332 Outer curvature
33 Contact point
34; 134; 234 Inner curvature
35 Elongation
36 Middle central axis
38 Straight boundary section
40; 140; 340 Rounded corner
44 Outer central axis
46 Line of symmetry
144 Inner central axis
348 Kidney-shaped suction port
350 Kidney-shaped pressure port
352 Web
x Smallest distance

What is claimed is:

1. A hydrostatic axial piston machine of swashplate type of construction, comprising:

a drive shaft configured to rotate about an axis of rotation;

a rotatable cylinder drum forming a multiplicity of cylinder bores; and a piston inserted into each cylinder bore at one side, wherein each cylinder bore is connected at the other side via a respective passage opening to a face surface of the cylinder drum, each passage opening oriented obliquely with respect to its respective cylinder bore, wherein each piston is configured to reciprocate along an axis that is not parallel to the axis of rotation of the drive shaft, wherein a respective mouth of each passage opening is arranged in the face surface and has a cross section that has two or four cross-sectional widenings with rounded corners, wherein the cross section has an outer curvature and an inner curvature wherein the outer curvature is arranged radially further toward the outside than a circular arc-shaped elongation of the inner curvature, wherein the outer curvature and the circular arc-shaped elongation have a distance therebetween, and wherein a kidney-shaped suction port of a distributor disk that bears against the face surface is broadened radially by the distance in relation to a kidney-shaped pressure port.

2. The hydrostatic axial piston machine according to claim 1, wherein the passage opening has, adjacent to the mouth or over its entire length, the same cross section as the mouth.

3. The hydrostatic axial piston machine according to claim 1, wherein the cross section has two lateral boundary sections that are straight.

4. The hydrostatic axial piston machine according to claim 3, wherein the lateral boundary sections run in the radial direction of the cylinder drum.

5. The hydrostatic axial piston machine according to claim 1, wherein the outer curvature is less intensely curved than the inner curvature.

6. The hydrostatic axial piston machine according to claim 5, wherein the cross section has two rounded corners arranged radially at the outside.

7. The hydrostatic axial piston machine according to claim 6, wherein the cross section has two lateral boundary sections that are straight, and wherein each corner merges in continuous fashion into one of the straight boundary sections.

8. The hydrostatic axial piston machine according to claim 1, wherein the two curvatures have opposite directions of curvature.

9. The hydrostatic axial piston machine according to claim 1, wherein the kidney-shaped suction port is arranged on the distributor disk radially further to the outside than the kidney-shaped pressure port by half of the distance.

10. The hydrostatic axial piston machine according to claim 1, wherein the cross section has four rounded corners.

11. The hydrostatic axial piston machine according to claim 10, wherein the cross section has two lateral boundary sections that are straight, and wherein one of the straight boundary sections extends in each case between two corners.

* * * * *